US006093066A

United States Patent [19]

Isogawa et al.

[11] Patent Number: 6,093,066

[45] Date of Patent: Jul. 25, 2000

[54] CONTROL FOR OUTBOARD MOTOR

[75] Inventors: Atsushi Isogawa; Takaji Kawai, both of Hamamatsu, Japan

[73] Assignee: Sanshin Kogyo Kabushiki Kaisha, Hamamatsu, Japan

[21] Appl. No.: 09/116,274

[22] Filed: Jul. 16, 1998

[30] Foreign Application Priority Data

Jul. 17, 1997 [JP] Japan ..... 9-207434

[51] Int. Cl.[7] ..... B63H 5/125

[52] U.S. Cl. ..... 440/63; 440/84; 440/86; 440/87

[58] Field of Search ..... 440/53, 63, 84, 440/85, 86, 87, 900

[56] References Cited

U.S. PATENT DOCUMENTS

| | | | |
|---|---|---|---|
| 545,064 | 8/1895 | Tsunekawa et al. | 440/86 |
| 2,703,989 | 3/1955 | Schroeder | 440/86 |
| 3,121,415 | 2/1964 | Anderson et al. | 440/86 |
| 5,421,755 | 6/1995 | Kakizaki | 440/86 |

*Primary Examiner*—Stephen Avila

*Attorney, Agent, or Firm*—Knobbe, Martens, Olson & Bear LLP

[57] ABSTRACT

An outboard motor throttle and transmission control that employs a bowden wire mechanism for transmitting control signals from the tiller handle to the engine throttle and transmission control. The control handle is pivotally mounted on the front end of a tiller arm and the wire actuators exit the control handle and enter the protective cowling on opposite sides of a longitudinal center plane or on opposite sides of the protective cowling so as to increase the length of the wire actuators in this area so as to facilitate their bending without kinking.

5 Claims, 6 Drawing Sheets

CONTROL FOR OUTBOARD MOTOR

BACKGROUND OF THE INVENTION

This invention relates to an outboard motor and more particularly to an improved control for an outboard motor.

In an outboard motor, many of the controls for the engine and transmission are carried by a tiller handle that is pivotally connected to the tiller or steering bar of the outboard motor. In this way, the operator can control the throttle, transmission and steering mode without taking his hand off of the tiller handle. This obviously has significant advantages.

Generally, the throttle and transmission control elements are connected to the engine throttle valve and transmission shift control via bowden wire actuators. These actuators are employed because they facilitate pivotal movement of the control handle relative to the tiller bar to a stored position wherein the control handle extends upwardly along the forward edge of the power head and does not protrude into the watercraft hull.

However, the two control wires are positioned in fairly close proximity to each other and considerable stress may be placed on the wire actuators during this pivotal movement. One reason for this is that the length of the bowden wire actuators in the area between the inner end of the tiller control handle and the point where they enter the protective cowling and where they are fixed to the relative component of the outboard motor is relatively short. This does not give adequate length for the wire actuators to avoid stresses and possible damage when the control handle is pivoted upwardly.

It is, therefore, a principle object of this invention to provide an improved control arrangement for an outboard motor.

It is a further object of this invention to provide an improved control arrangement for an outboard motor utilizing bowden wire actuators and wherein they can be bent to a substantial degree during positioning in a storage condition without placing high stresses on them.

SUMMARY OF THE INVENTION

This invention is adapted to be embodied in an outboard motor comprised of a power head comprised of a powering internal combustion engine and a surrounding protective cowling. A drive shaft housing and lower unit depends from the power head and contains a propulsion device for propelling an associated watercraft. The propulsion device is driven by the engine through a transmission that includes a forward, neutral, reverse transmission. The engine has a throttle control. Affixed to the outboard motor and extending forwardly from it is a tiller bar for steering of the outboard motor. A control handle is pivotally connected to the tiller bar for pivotal movement about a generally horizontally extending axis so that the control handle can be pivoted from an operative position to an upwardly directed storage position where it does not protrude substantially into the hull of an associated watercraft. A throttle control element and a transmission control element are supported on a forward end of the control handle for controlling the engine speed control and the shifting of the transmission, respectively. Bowden wire actuators connect the throttle control element and the transmission control element to the engine throttle and transmission, respectively. These bowden wire actuators have a portion that is affixed to a rear end of the control handle and when they exit it for entry into the power head through the protective cowling. The wire actuators exit the control handle on a side thereof that is opposite to the side of the protective cowling through which these wire actuators enter so as to provide a greater exposed length of the wire actuators so as to facilitate their bending without kinking during pivotal movement of the control handle between its position.

DETAILED DESCRIPTION OF THE PREFERRED EMBODIMENT

Figure 1:
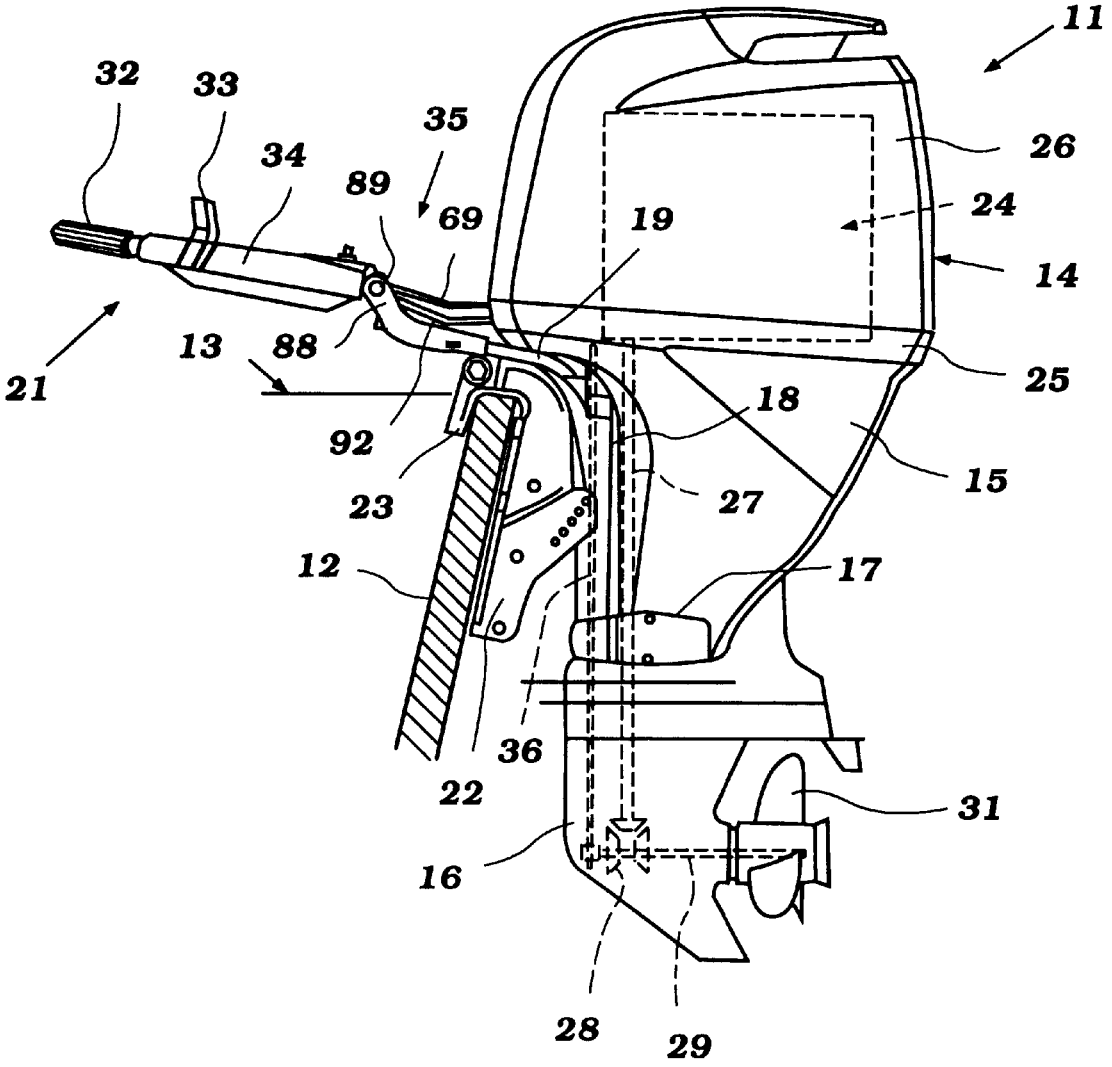
FIG. 1 is a side elevational view of an outboard motor constructed in accordance with an embodiment of the invention, shown attached to the transom of a watercraft which is shown partially and in cross-section.

Referring now in detail to the drawings and initially to FIG. 1, an outboard motor constructed in accordance with an embodiment of the invention is identified generally by the reference numeral 11. The outboard motor 11 is shown attached to a transom 12 of an associated watercraft which is shown partially in cross-section and which is identified generally by the reference numeral 13.

The outboard motor 11 is comprised of a power head, indicated generally by the reference numeral 14, a drive shaft housing 15, and a lower unit 16. The drive shaft housing 16 has affixed to it a steering shaft, which does not appear in the drawings, but which is attached by means that include a lower mounting bracket 17. This steering shaft is journaled for rotation about a generally vertically extending steering axis within a swivel bracket 18. A tiller 19 is affixed to the upper end of the steering shaft and is connected, in turn, to a tiller control handle indicated generally by the reference numeral 21.

The swivel bracket 18 is pivotally connected to a clamping bracket 22 by means of a pivot pin 23. Pivotal movement of the swivel bracket 18 relative to the clamping bracket 22 about the pivot pin 23 permits tilt and trim adjustment of the outboard motor 11, as is well known in the art.

The power head 14 is comprised of a powering internal combustion engine, which is indicated in FIG. 1 in phantom and identified by the reference numeral 24. The construction of this engine 24 will be described in more detail later by reference primarily FIG. 5.

The engine 24 is enclosed within a protective cowling which is comprised of a lower tray number 25 and an upper, main cowling member 26 that is detachably connected to the tray 25 in any known manner.

As is typical with outboard motor practice, the engine 24 is positioned in the power head 14 so that its crankshaft, to be described later, rotates about a vertically extending axis. This is done so as to facilitate connection to a drive shaft 27 that is journaled appropriately in the drive shaft housing 15 and which extends into the lower unit 16.

In the lower unit 16, there is provided a conventional forward, neutral, reverse bevel gear transmission 28 which selectively drives a propeller shaft 29 in forward or reverse direction. A propeller 31 is affixed to this propeller shaft 29 and provides the propulsion for the watercraft 13.

The tiller control handle 21 has certain controls for the outboard motor 11. These include a twist grip throttle control 32 and a pivotally supported transmission control 33. These portions are mounted on a handle assembly 34. A bowden wire actuating mechanism, indicated generally by the reference numeral 35 and which incorporates the invention, connect the throttle control 32 and transmission control 33 to the respective components of the outboard motor, as will be described later. However, while still referring to FIG. 1, the shift control 33 operates a shift rod 36 which, in turn, operates the transmission 28 to effect its shifting between the various drive conditions, i.e. forward, neutral and reverse.

Referring now in detail to the remaining figures, and initially primarily to FIG. 5, the construction of the engine 24 will be described in more detail. In the illustrated embodiment, the engine 24 is depicted as being of the four cylinder in-line type. It will be readily apparent to those skilled in the art, however, that the invention can be utilized in conjunction with engines having other cylinder numbers and other cylinder configuration. Also, the invention can be utilized in conjunction with two cycle engines.

The engine 24 is comprised of a cylinder block 37 in which four aligned, vertically spaced, cylinder bores 38 are formed in a suitable manner. The axes of these cylinder bores 38 extend horizontally so as to orient the engine as required for outboard motor practice, as aforenoted.

A cylinder head assembly 39 is affixed to one end of the cylinder block 37 in a well known manner. This cylinder head 39 has individual recesses 41 that lie over each of the cylinder bores 38 and function to form a portion of the combustion chambers, as will become apparent.

A crankcase member 42 is affixed to the opposite end of the cylinder block 37 also in an appropriate manner. This crankcase member 42 with a skirt of the cylinder block 37 forms a crankcase chamber 43 in which a crankshaft 44 is rotatably journaled in any known manner. The crankshaft 44, as already noted, rotates about a vertically extending axis.

Pistons 45 are supported for reciprocation in each of the cylinder bores 38. These pistons 45 are connected by means of piston pins 46 to connecting rods 47. The other ends of the connecting rods 47 are journaled on the throws of the crankshaft 44 in a known manner for driving the crankshaft.

An induction system is provided for supplying an air charge to the combustion chambers formed by the cylinder head recesses 41, the heads of the pistons 45 and the cylinder bores 38. This induction system includes an elongated air inlet device and plenum chamber, indicated by the reference numeral 48, and which is positioned in spaced relationship to the forward end wall 49 of the crankcase member 42. An air silencer (not shown) may be associated with the inlet device 48 for drawing air from within the protective cowling to the inlet device 48.

The main cowling member 26 is formed with a suitable atmospheric air inlet so as to admit atmospheric air into the interior of the protective cowling.

The plenum chamber device 48 may be considered to be part of an intake manifold which has individual runners 51, each of which extends to a respective throttle body 52, which is disposed on one side of the engine and in spaced relationship to the cylinder block 37. The throttle bodies 52 journal throttle valve shafts 53, each of which carry a flow controlling throttle valve 54 for controlling the air flow through the induction system.

The throttle bodies 52 communicate at their downstream ends with a manifold 55 having a passage 56 that communicates with a cylinder head intake passage 57. These cylinder head intake passages 57 terminate at intake valve seats 58 formed in the cylinder head recess 41.

Poppet type intake valves 59 are mounted in the cylinder head assembly 39 and cooperate with these valve seats 58 to control the flow therethrough. Coil compression spring assemblies 60 cooperate with the valves 59 for holding them in their closed position. An intake camshaft 61 is journaled in the cylinder head assembly 56 for opening the intake valves 59. This intake camshaft 61 is driven from the crankshaft 44 at one half crankshaft speed through a suitable timing mechanism, in a manner well known in this art In addition to the air supplied to the combustion chamber 41 by the air induction system, there is also supplied fuel by means of some form of charge former. This may either comprise employing either an addition to the throttle bodies 52 or in combination with them a carburetor for each cylinder. Alternatively, fuel injection systems can be employed that inject fuel either into the manifold section 55, directly into the cylinder head intake passages 57 or direct cylinder injection. Since the invention deals primarily with the transmission and throttle control mechanisms, the actual charge former employed has not been illustrated. Those skilled in the art will readily understand how the invention can be practiced with various types of charge forming systems.

The charge that is formed in the combustion chambers 41 in any of the afore-described manner is then fired by a spark plug (not shown). The spark plugs are mounted in the cylinder head assembly 39 and have their gaps protruding into the respective combustion chamber recesses 41 for firing the charge therein.

The charge which has burned in the combustion chambers 41 is then discharged through an exhaust system. This exhaust system includes an exhaust valve seat 62 formed in each cylinder head recess 41 which communicates with an cylinder head exhaust passage 63. A poppet type exhaust valve 64 controls the opening and closing of each exhaust valve seat 62.

This poppet type exhaust valve 64 is urged to its closed position by a coil compression spring assembly 65. An exhaust camshaft 66 is rotatably journaled in the cylinder head 39 in an appropriate manner for opening the exhaust valves 64. The exhaust camshaft 66, like the intake camshaft 61, are driven at one half crankshaft speed by a suitable timing drive.

The cylinder head exhaust passage 63 has a re-entrant section that communicates with an exhaust collector section and exhaust manifold 67 formed in the cylinder block 37. This exhaust manifold 67 delivers the exhaust gases downwardly to a conventional type of exhaust system provided in the drive shaft housing 15 and lower unit 16.

As is typical in the marine art, this exhaust system may include a high speed underwater exhaust gas discharge and an above the water low speed idle discharge. Such systems are well known in the art and, for that reason, further description of the exhaust system is not believed to be necessary to permit those skilled in the art to practice the invention. Resort may be had to any conventional structure with which to utilize the invention of this application.

As has been noted, the twist grip throttle control 32 operates a wire actuator mechanism 35. This mechanism 35 includes a throttle control wire actuator 68 that is contained within a protective sheath 69 which is clamped or suitably fixed to the tray 25 of the protective cowling of the power head 14. This wire actuator mechanism will be described in more detail later.

Figure 5:
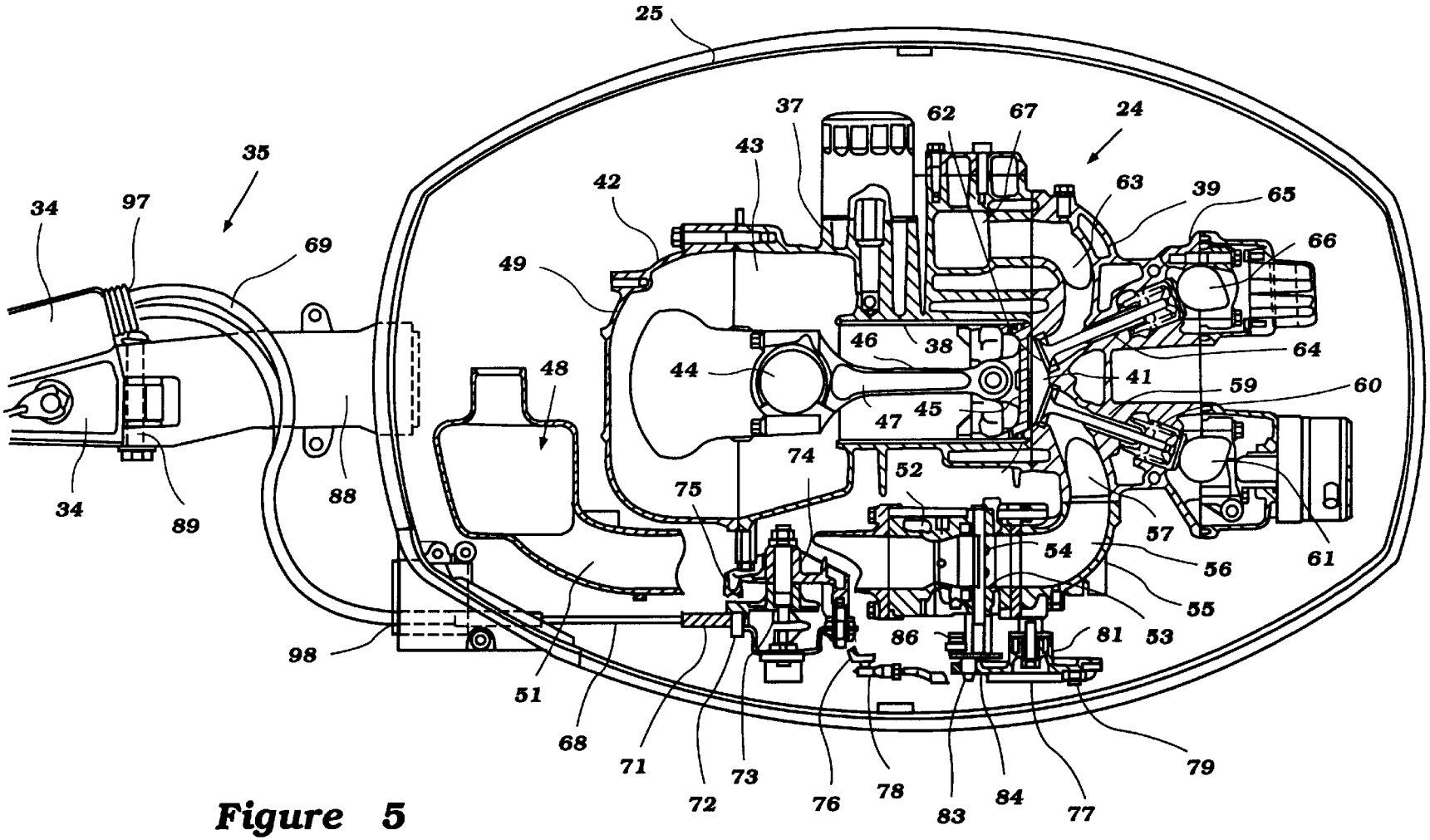
FIG. 5 is a top plan view, looking in the same direction as FIG. 4, but showing the construction illustrated in FIG. 3, with the engine shown in cross-section.

This wire actuator 68 is connected by means of a ferrule 71 to a pin 72 carried on an intermediate shaft lever arm 73 that is best shown in FIG. 5, although it appears in additional figures. This intermediate lever arm 73 is fixed for rotation on an intermediate throttle control shaft 74 which is, in turn, journalled relative to the engine body and specifically the skirt 43 of the cylinder block 37 by means of a mounting bracket assembly 75.

Figure 3:
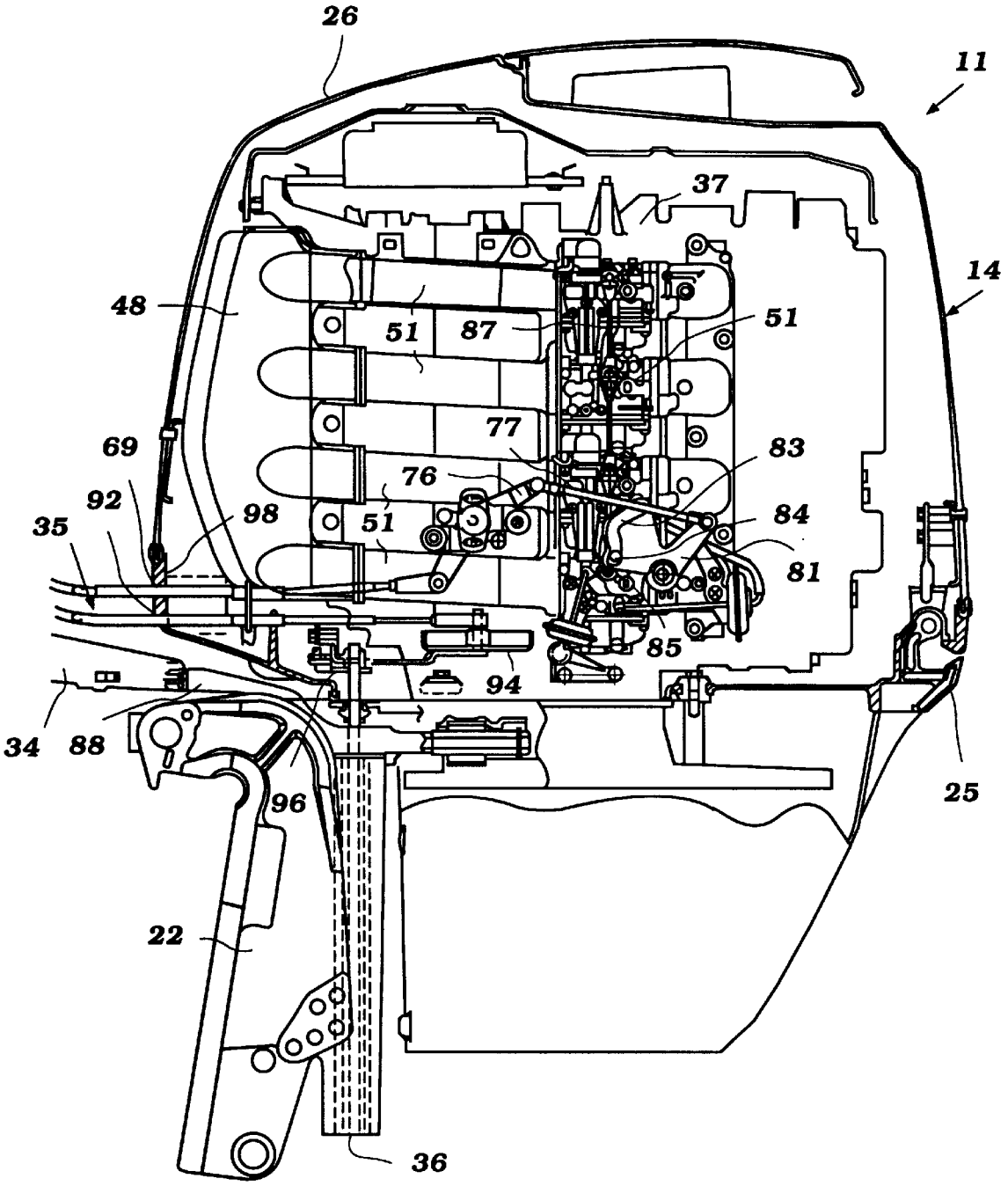
FIG. 3 is a further enlarged view looking in the same direction as FIG. 2, but showing more of the power head construction and its association with the clamping bracket.
Figure 6:
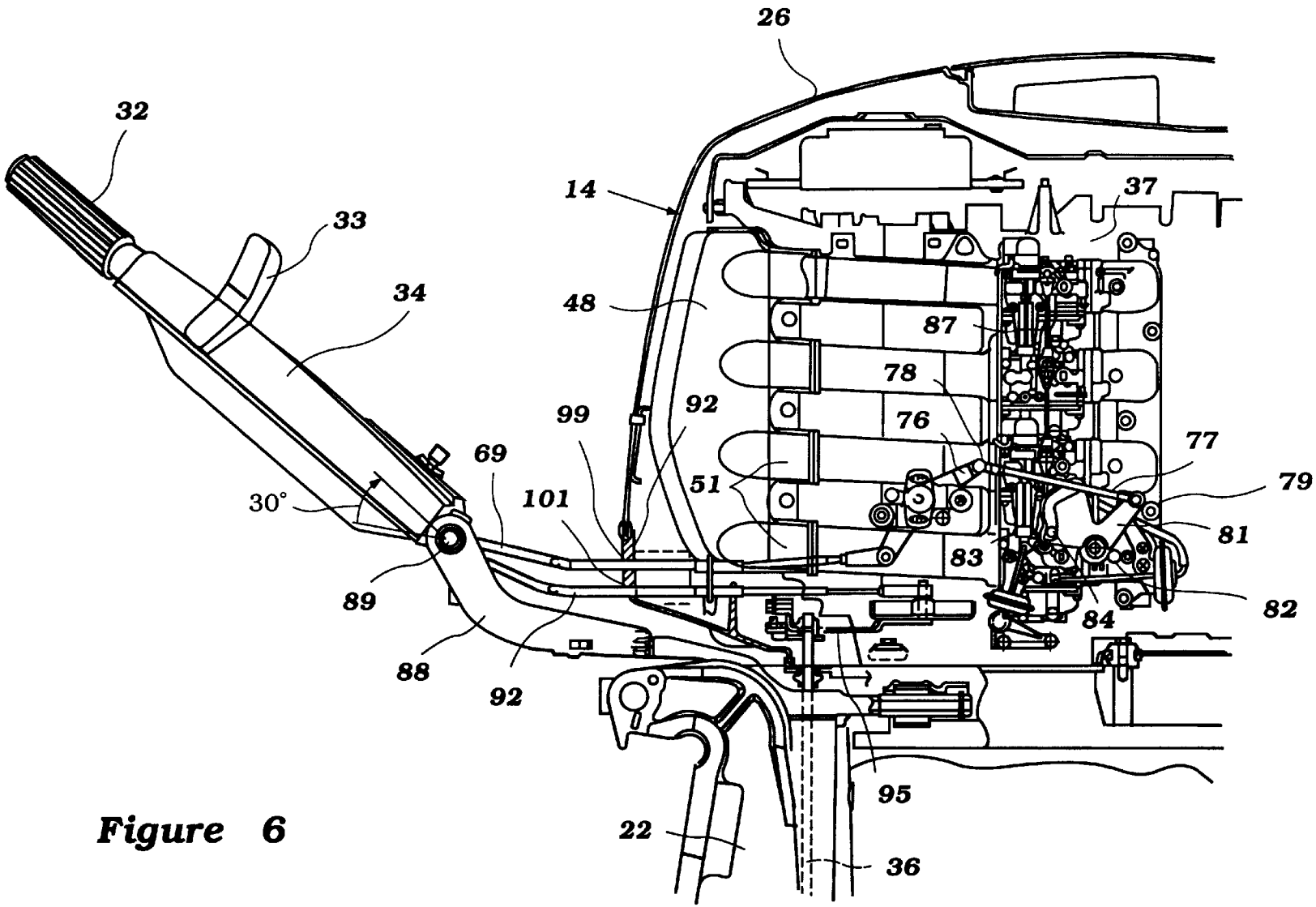
FIG. 6 is a view looking, in part similar to FIG. 2, but shows the control handle pivoted up partially toward a storage position.

A further lever arm 76 is affixed for rotation with the lever arm 73 as best seen in FIGS. 3, 5 and 6. This further lever arm 76 is connected to a throttle control link 77 by means of a spherical connection 78. The throttle control link 77 is connected by a pivot joint 79 at its opposite end to a throttle actuating lever 81. The throttle actuating lever 81 is journaled on one of the intake manifold sections 55 and in the illustrated embodiment, this is the one associated with the lowermost throttle body 52. A pivot pin 82 is provided for this purpose.

The throttle actuating lever 81 is provided with a cam-shaped slot 83 in which a throttle pin 84 is received. The throttle pin 84 is carried by a throttle lever 85 that is affixed to the throttle valve shaft 53 of the lowermost throttle body 52 by means of an adjustable coupling 86.

When the operator twists the throttle grip 32, the wire actuator 68 will be drawn to the left and this will cause the throttle control links 73 and 76 to rotate about the pivotal support for the intermediate throttle control shaft 74. This places a compressive force on the link 77 which causes the throttle control lever 81 to rotate in a clockwise direction to the position shown in FIGS. 3 and 6. During this rotation, the cam slot 83 will act on the throttle pin 84 and rotate the throttle valve 54 and its associated throttle valve shaft 53 toward their fully opened positions. The throttle valves of the remaining throttle bodies 52 are operated by a synchronizing mechanism of a suitable type such as one including synchronizing links 87.

Figure 2:
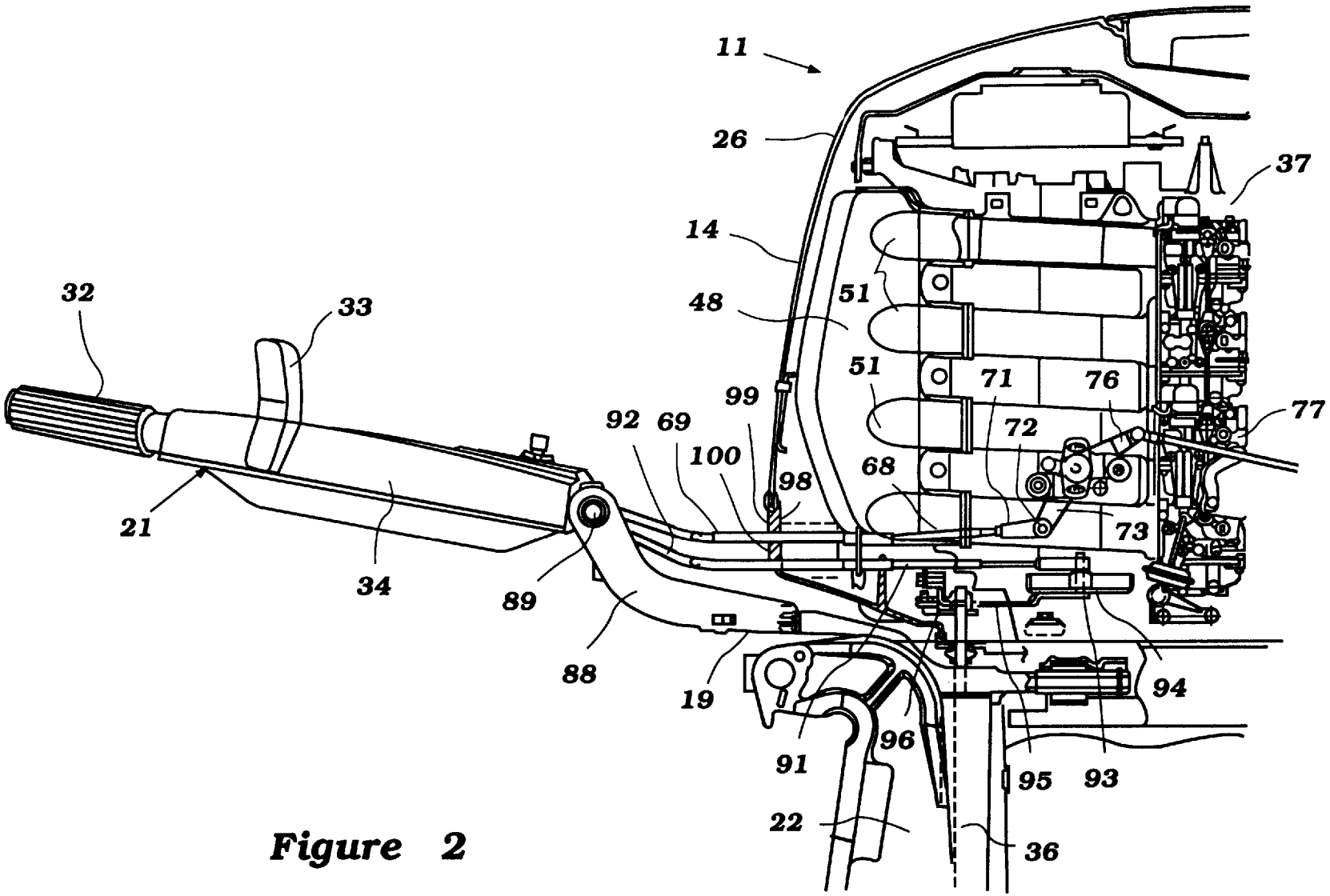
FIG. 2 is an enlarged view looking in the same direction as FIG. 1, but with portions of the protective cowling broken away and in order to show the control assembly in more detail.

The mechanism by which the twist grip throttle control 32 and shift control lever 33 are coupled to the power head and the connection of the shift control lever 33 to the shift control rod 36 will now be described, as will the pivotal support for the control handle 34 on the tiller 19. Referring first primarily to FIGS. 1 and 2, it will be noted that the tiller 19 has connected to it a first bracket member 88 which forms a part of the control handle assembly 21. The control handle body 34 is pivotally connected to this bracket 88 by means of a pivot pin 89. This permits the control handle portion 34 to be moved between the normal control position as shown in FIGS. 1–5 wherein it extends generally forwardly over the transom 12 of the watercraft 13 and to an area within the watercraft to an upper position adjacent the power head 14 for storage or access purposes. FIG. 6 shows the mechanism rotated to about 30° toward this position.

Normally, this motion will place a fairly high stress on the bowden wire actuator 68 and its protective sheath 69 for the throttle mechanism and on a bowden wire actuator 91 and its protective sheath 92. This latter bowden wire actuator 91 is connected to the shift rod 36 through a cam and follower mechanism comprised of a roller follower 93 that is received in a cam 94 and which cam is connected by a length 95 to a control rod 96 on the upper end of the shift lever 36.

Figure 4:
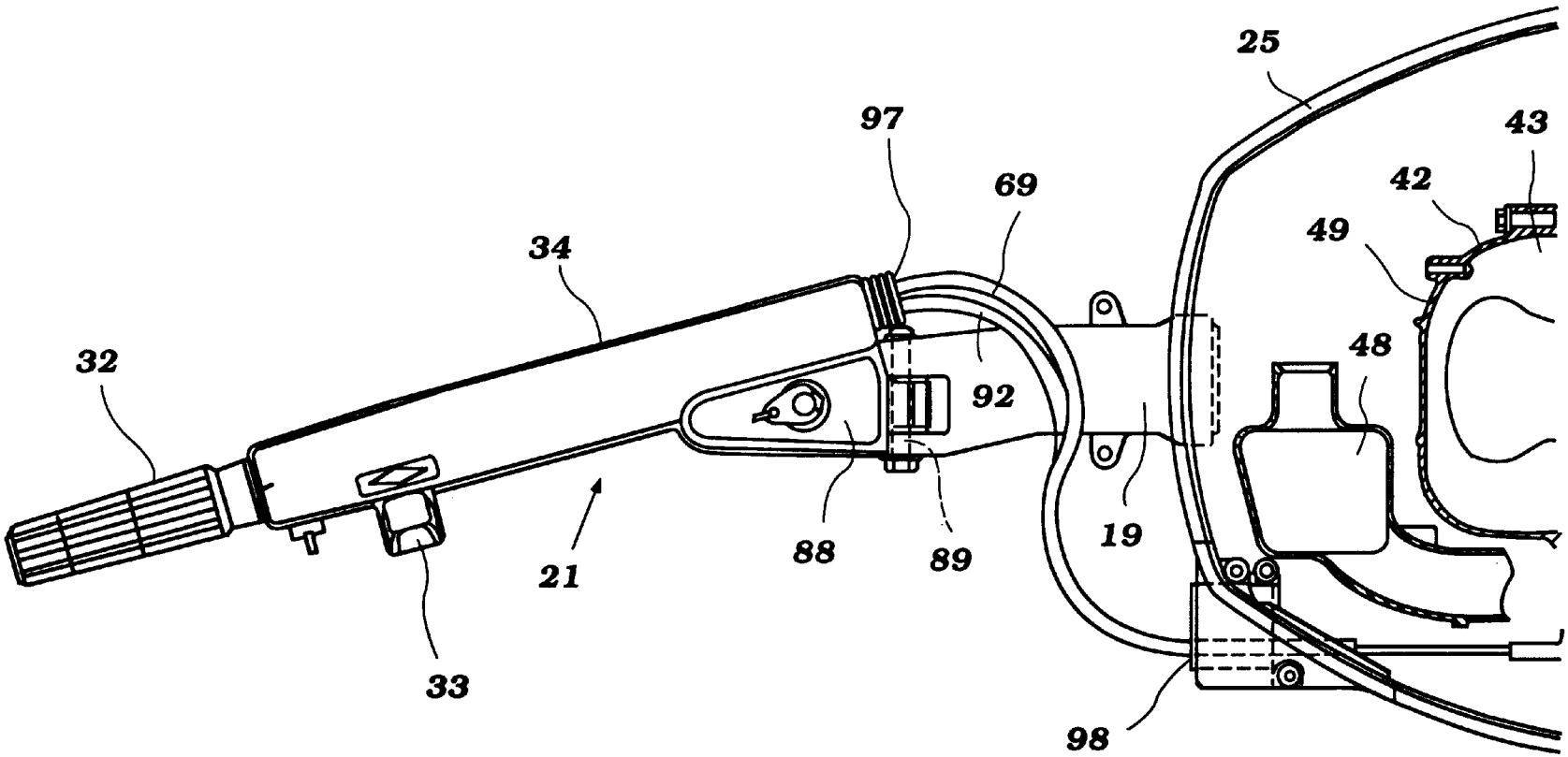
FIG. 4 is a top plan view of the same portion of the outboard motor structure shown in FIG. 2, again with portions of the protective cowling shown removed and with a part of the engine broken away and shown in section.

In accordance with the invention and as best seen in FIG. 4, the two protective sheaths 69 and 92 exit the control handle portion 34 through a grommet mechanism 97 which holds these control wires in side-by-side relationship on one side of the tiller arm 19. These wire actuators then cross over the tiller arm 19 and enter through the tray portion 25 of the power head through a further grommet assembly 98. This grommet assembly 98 holds the two sheath portions in respective vertically spaced holes 99 and 101 so as to maintain their spacing as best seen in FIG. 2. As a result, there is a relatively long run for these unsupported portions of the wire actuator 69 and 92 that will permit them to flex when the tiller handle 34 is pivoted to its upward position and thus avoid kinking.

Thus, the goal of avoiding this is obtained through this mechanism. Of course, this is a preferred embodiment of achieving this result and the various changes and modifications may be made without departing from the spirit and scope of the invention, as defined by the appended claims.

We claim:

1. An outboard motor comprised of a power head comprised of a powering internal combustion engine and a surrounding protective cowling a drive shaft housing and lower unit depending from said power head and containing a propulsion device for propelling an associated watercraft, drive means for driving said propulsion device by said engine including a forward, neutral, reverse transmission, said engine having a throttle for controlling the speed of said engine, a tiller bar affixed to said drive shaft housing and extending forwardly from said drive shaft housing for steering of said outboard motor, a control handle pivotally connected to said tiller bar for pivotal movement about a generally horizontally extending axis so that said control handle can be pivoted from an operative position to an upwardly directed storage position where it does not protrude substantially into the hull of an associated watercraft, a throttle control element and a transmission control element supported on a forward end of said control handle for controlling said engine speed control and the shifting of said forward, neutral, reverse transmission, respectively, and first and second bowden wire actuators for connecting said throttle control element and the transmission control element to said engine throttle and said transmission, respectively, said bowden wire actuators each having a first portion affixed to a rear end of said control handle and a second portion entering into said power head through said protective cowling, said first portions of said wire actuators exiting said control handle on a side thereof that is opposite to the side of said protective cowling through which the second portions of said wire actuators enter said protective cowling so as to provide a substantial exposed length of said wire actuators so as to facilitate their bending without kinking during pivotal movement of said control handle between its positions.

2. An outboard motor as set forth in claim 1 wherein the second portions of the bowden wire actuators are fixed relative to the protective cowling.

3. An outboard motor as set forth in claim 2 wherein the first portions of the bowden wire actuators are fixed relative to the control handle in horizontally spaced relation.

4. An outboard motor as set forth in claim 2 wherein the second portions of the bowden wire actuators are fixed relative to the protective cowling in vertically spaced relation.

5. An outboard motor as set forth in claim 4 wherein the first portions of the bowden wire actuators are fixed relative to the control handle in horizontally spaced relation.

* * * * *